United States Patent [19]

Garrett

[11] Patent Number: 4,880,171

[45] Date of Patent: Nov. 14, 1989

[54] APPARATUS FOR THE PRODUCTION OF PULP SUSPENSIONS

[76] Inventor: Roderick D. Garrett, P.O. Box 2996, San Rafael, Calif. 94912

[21] Appl. No.: 233,768

[22] Filed: Aug. 19, 1988

[51] Int. Cl.[4] ..... B02C 23/36

[52] U.S. Cl. ..... 241/46.11; 241/46.17; 241/97

[58] Field of Search ..... 241/46.17, 46.11, 172, 241/46 B, 79, 46.06, 80, 97; 162/4

[56] References Cited

U.S. PATENT DOCUMENTS

| | | |
|---|---|---|
| 2,289,612 | 7/1942 | Wells . |
| 3,305,180 | 2/1967 | Tomlinson . |
| 3,339,851 | 9/1967 | Felton et al. . |
| 3,380,669 | 4/1968 | Hatton . |
| 3,486,702 | 12/1969 | Kmeco . |
| 3,506,202 | 4/1970 | Cumpston . |
| 3,578,250 | 3/1971 | Combs et al. . |
| 4,199,110 | 4/1980 | Eriksson . |
| 4,283,275 | 8/1981 | Heinbolkel et al. . |
| 4,387,856 | 6/1983 | Selder . |
| 4,396,160 | 8/1983 | Rienecker et al. . |
| 4,397,713 | 8/1983 | Lambrecht . |
| 4,634,059 | 1/1987 | Bahr et al. . |

FOREIGN PATENT DOCUMENTS

| | | | |
|---|---|---|---|
| 2254773 | 5/1974 | Fed. Rep. of Germany | 241/46.17 |
| 2359815 | 7/1974 | Fed. Rep. of Germany | 241/46.17 |
| 456868 | 6/1975 | U.S.S.R. | 241/46.17 |

*Primary Examiner*—Mark Rosenbaum

[57] ABSTRACT

An improved hydropulper and mixer for pulp production and associated tasks, in particular for gently rehydrating and separating processed fiber. The apparatus comprises a vessel, a lower chamber containing a rotatory mechanism, a rotary drive and a tube for re-circulating the slurry. A sized aperture in the bottom of the vessel, which controls vortexing and excessive swirling, opens into the chamber. The chamber safely encloses a vanned rotor which vigorously pulps the fiber while impelling the flow through an outlet and tube back to the vessel. The slurry recycles until the quality is judged satisfactory. A de-watering screen can then be introduced into the flow, saving the water for re-use, or the slurry can be redirected to another location by the same integral pumping action.

4 Claims, 1 Drawing Sheet

Fig. 1
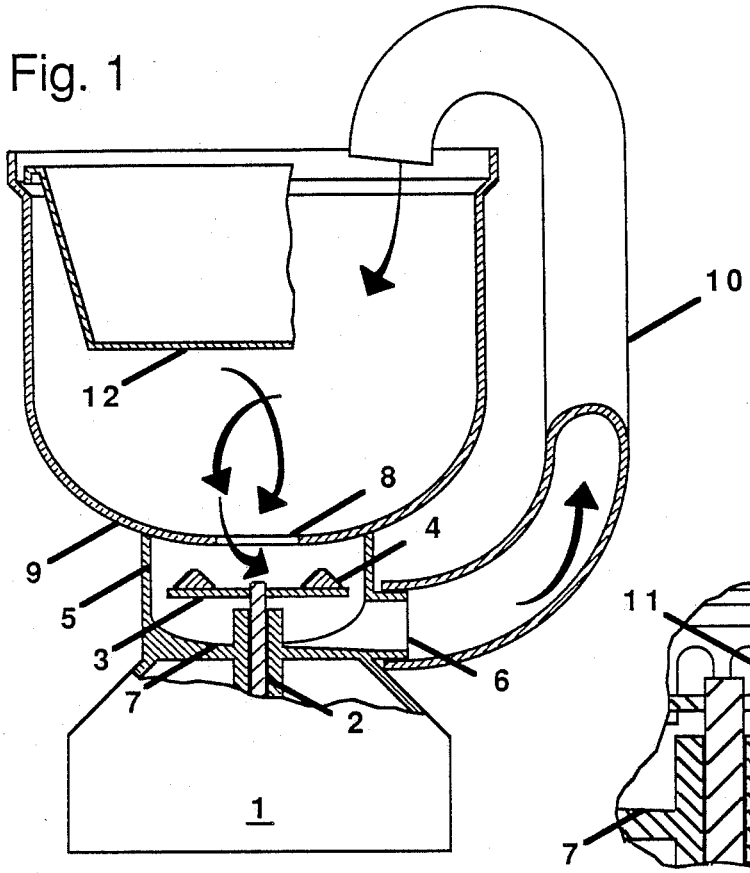
Fig. 3
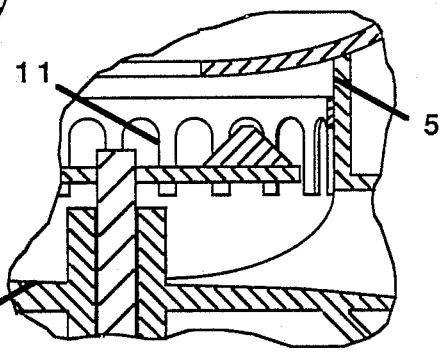
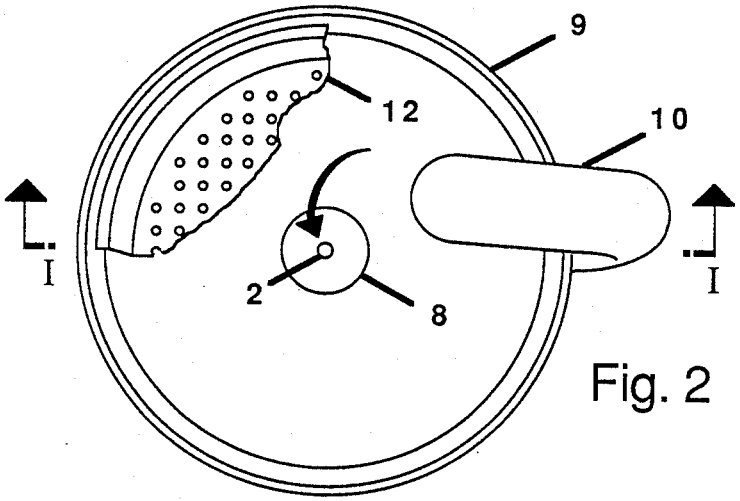
Fig. 2

APPARATUS FOR THE PRODUCTION OF PULP SUSPENSIONS

BACKGROUND

1. Field of Invention

This invention relates to a Hydropulper and Mixer for pulp production, in particular for gently re-hydrating pre-processed paper pulp and for performing a wide variety of other tasks.

2. Discussion of Prior Art

Heretofore, the prior art has been primarily concerned with the pulping of fiber for commercial production, where-in delicate treatment of the fiber was unimportant. Typically this has been done in a water-filled vessel which has grinders and/or sharp blades mounted in the lower portion.

The effect of these machines was to shorten and curl the fibers while they were being separated. Many such machines incorporated a means to strain or grade the slurry, these were subject to clogging and caused the fiber to knot and string. Unenclosed shearing and stirring mechanisms in the vessel posed a danger to the operator.

These machines were commonly quite large, heavy and costly; because of this, the machine most commonly used for hydropulping was the kitchen blender, a substitute which was inadequate in performance as well as highly destructive to the fiber. It is seen that a common need had not been met, that was for a simple, economical and compact hydropulper which would properly re-hydrate and disperse pre-processed fiber which is most highly employed by schools and individually for use in hand papermaking.

OBJECTS AND ADVANTAGES

Accordingly, several objects and advantages of my invention are:

To provide a hydropulper which can quickly separate and hydrate pre-processed fiber and do so without shortening the fiber and thus reducing the strength of an unadulterated product; to provide such a machine which will produce a pulp without knots or strings of fiber that would distort the surface finish or thickness of the product and a pulp in which the fibers are not curled so as to result in a loose and weak aggregation of fiber in the product. In these objects to provide a better condition of the pulp than in the prior art. To provide a hydropulper that is simple in construction with a modicum of moving and stationary parts to cause problems, and allowing it to be light weight, compact and economical. To provide a machine that is safer to operate in that there is an absence of cutters or grinders, and that the mechanism is enclosed. To provide a hydropulper that is easier to operate by incorporating an integral pumping means to recycle the slurry through the mechanism, thus allowing control of the pulp quality without strainers or mechanical adjustment. Also thus allowing efficient use of a de-watering apparatus and easy transfer of the pulp to another location. To provide in this hydropulper a multi-purpose machine that is an effective, non damaging blender of pulp with other materials, as well as a mixer of other solutions. In addition, to provide a hydropulper with most of the stated objects and advantages, which has a refining means in the chamber and thus can also convert other kinds of fibrous material into a pulp slurry. Further objects and advantages of this invention will become apparent from a consideration of the drawings and ensuing description of it.

DESCRIPTION OF DRAWINGS

FIG. 1 shows a sectional side view of the machine according to the invention with dewatering apparatus in place and taken along the line I—I of FIG. 2.

FIG. 2 shows a top view without dewatering apparatus taken along the line II—II of FIG. 1.

FIG. 3 shows a portion of the chamber 5 of FIG. 1 with a spaced refining means.

LIST OF REFERENCE NUMERALS

1. Rotary Drive
2. Shaft Member
3. Rotor plate
4. Vane
5. Chamber
6. Outlet Port
7. Chamber Floor
8. Aperture
9. Vessel
10. Tube
11. Spaced Refining Means
12. Removable De-watering Apparatus

DESCRIPTION

FIGS. 1 and 2 show a hydropulper according to the preferred embodiment of the invention. The machine comprises a vessel 9, a tube 10 and a chamber 5, these being preferable made of plastic, the chamber containing a rotational mechanism 2,3 and 4 preferably made of stainless steel and connected to a rotary drive 1. In the bottom wall of the vessel 9 is an aperture 8 of a certain size sufficient to allow proper mixing in the vessel 9; but small enough to prevent vortexing and excessive swirling in the vessel 9 this being critical to the elimination of flow restraining devices. The aperture opens into a lower chamber 5 which is comprised of a circular wall and a floor 7 which is depressed toward an outlet port 6 in the lower portion of the chamber wall. It is by locating the rotatory mechanism in a chamber 5 that the principle advantages of this invention are made possible. This mechanism is comprised of a round rotor plate 3, with affixed vanes 4 and a shaft member 2 which is connected to a rotary drive. The space between the floor 7 and the rotor plate 3 acts as a pump volute. The space between rotor plates 3 and said chamber wall is an annular passage. Inside the upper periphery of rotor plate 3 are two vertical vanes 4 which are mounted axially and in parallel. Attached at the center of rotor plate 3 is a shaft member 2 which extends down through the floor of the chamber to a rotary drive 1. Attached to the outlet port 6 is a flexible tube the other end of which is positioned into the top of the vessel 9 and attached there by a removable means such as a clip (not shown), also shown is a removable de-watering apparatus 12, such as a net bag fixed into a perforated bucket, which can be placed into or over the vessel 9 under the outlet end of the tube 10. FIG. 3 shows a portion of the chamber 5 and refers to the same apparatus as described, but with a spaced refining means 11, such as a plurality of ribs, in the annular passage opposed to the rotor plate 3 and vanes 4.

This invention performs a number of functions related to papermaking, but one of it's greatest values is in re-hydrating processed pulp. For this embodiment, no cutters or shredders which would damage the fiber are employed. The user adds water to the vessel 10, activates the rotary drive 1 and introduces pieces of processed fiber. The aggregated fiber is drawn down through an aperture 8 by the flow of the water as it is cycled through the apparatus. Vortexing and excessive swirling is controlled not by the typical fixed restraining vanes, flow deflecting impellors, or lids, but by the size of the aperture 8. This size is sufficient to allow proper mixing in the vessel 9, but small enough to limit the transfer of centrifugal force from the chamber 5 to the vessel 9. The chamber 5 is the key element in this invention in that it no only protects the operator from the mechanism, but together with the limited aperture 8, confines the centrifugal force sufficiently to allow control and use of the hydrodynamic effects for mixing, pulping and pumping.

Upon entering the chamber, the mixture is subjected to concentrated agitation and blunt impact from the vanes 4 which create a rapid efferent circular flow. The fiber is readily separated into a slurry which can be drawn down through the annular passage. The centrifugal velocity of the slurry is guided into a tangential direction by the sloping depression of the floor which acts as a pump volute. The slurry is thereby forced through the outlet port 6 and into the tube 10, within which the hydraulic pressure may be used to direct the slurry back into the vessel 9. This means of pumping the slurry is simpler and more efficient than those requiring a separate pump mounted in series.

The slurry is allowed to cycle through the sequence until, by visual examination, it acquires the desired qualities. This allows the operator or vary these qualities without using mechanical adjustment and eliminates the need for a device to strain the pulp for particle size and the inherent problems attending this. The pulp can then be redirected through tube 10 to another location, or the pulp can be separated from excess water by interposing a de-watering apparatus 12 between the outlet of the tube 10 and the interior of the vessel 9, thereby saving the water for re-use.

In another embodiment of the invention, spaced refining means 11 are opposed to the rotor 3. The operation is as described, although tougher materials, such as unrefined fiber and waste paper, can be used. The embodiments may also be operated in the same way to mix in additives to make solutions and to blend other materials in a liquid.

Thus the reader will see that his invention provides a versatile, reliable and effective device which is also efficient, safe and convenient. While the description contains many specifications, the reader should not construe these a limitations on the scope of the invention, but merely as exemplifications of preferred embodiments and uses there of.

Skilled artisans will readily be able to change the proximity, numbers, shapes and materials of the various elements. For example they can make many variations on the refining means, or the rotor plate and vanes. They can place the aperture off center in the vessel so as to cause a cross-flow or use a truncated cone shape for the upper part of the chamber to further modify the fluid dynamics. In addition, there are other uses for this machine, such as destroying documents, to which it could be put. Accordingly the reader is requested to determine the scope of this invention by the appended claims and their legal equivalents and not by the examples which have been given.

I claim:

1. A pulping and mixing apparatus comprising:

an open vessel having side walls and a bottom wall, with an aperture therein, said aperture of a configuration which controls the transfer of centrifugal hydraulic force, a chamber adjacent to said aperture having a wall and a floor, said floor being sloped as a volute so as to take advantage of the said centrifugal force, conserved in said chamber, by trajecting it to an outlet port placed in the chamber wall so as to receive the directed hydraulic force, a tube communicating from said outlet port to said vessel, a shaft member generally vertically disposed into said chamber through said floor so as to avoid mechanisms in said vessel, a rotor plate attached to the top of said shaft member having a periphery spaced slightly from the said chamber wall, said rotor plate having a plurality of vanes there on, said chamber containing said rotor plate and vanes, a means for rotating said shaft member.

2. The pulping and mixing apparatus of claim 1 with a de-watering means interposed between the tube and the vessel so as to take advantage of the pumping action.

3. The pulping and mixing apparatus of claim 1 with a spaced refining means in the chamber.

4. The pulping and mixing apparatus of claim 1 with a flexible tube as a means of redirecting the flow through said tube.

* * * * *